United States Patent [19]

Ikonen et al.

[11] Patent Number: 4,587,687

[45] Date of Patent: May 13, 1986

[54] MOUNTING PIECE FOR SUCTION HOSE OF A CENTRAL VACUUM CLEANING SYSTEM

[75] Inventors: Alpo Ikonen, Muurame; Raimo Lehtolahti, Jyväskylä ; Reino Mustalampi, Muurame, all of Finland

[73] Assignee: Allaway Oy, Jyväskylä , Finland

[21] Appl. No.: 672,242

[22] PCT Filed: Feb. 21, 1984

[86] PCT No.: PCT/FI84/00019

§ 371 Date: Nov. 2, 1984

§ 102(e) Date: Nov. 2, 1984

[87] PCT Pub. No.: WO84/03428

PCT Pub. Date: Sep. 13, 1984

[30] Foreign Application Priority Data

Mar. 4, 1983 [FI] Finland ..... 830747

[51] Int. Cl.[4] ..... A47L 5/38

[52] U.S. Cl. ..... 15/314; 15/422

[58] Field of Search ..... 15/314, 422; 200/61.6; 137/360, 362

[56] References Cited

U.S. PATENT DOCUMENTS

| | | | |
|---|---|---|---|
| 1,255,176 | 2/1918 | Kellogg | 200/61.6 |
| 1,755,151 | 4/1930 | Henderson | 15/422 X |
| 2,703,905 | 3/1955 | Faith-Ell | 15/422 X |
| 2,877,313 | 3/1959 | Stoicos | 15/314 |
| 3,357,039 | 12/1967 | Hayward | 15/314 |

FOREIGN PATENT DOCUMENTS 215225 9/1967 Sweden .

*Primary Examiner*—Chris K. Moore

*Attorney, Agent, or Firm*—Cushman, Darby & Cushman

[57] ABSTRACT

This invention relates to a mounting piece for the suction hose of a central vacuum cleaning system. In order to prevent objects that could possibly clog the suction piping from getting into the piping, there is on the inner wall (2) of the mounting piece (1) at least one rib (3) pointing inwards from the inner wall which prevents objects that would clog the suction piping (5) from getting into the suction piping (5). The surface of the rib (3) or ribs (3) that meet the flow are preferably inclined towards the central axis of the mounting piece.

9 Claims, 6 Drawing Figures

FIG. 1
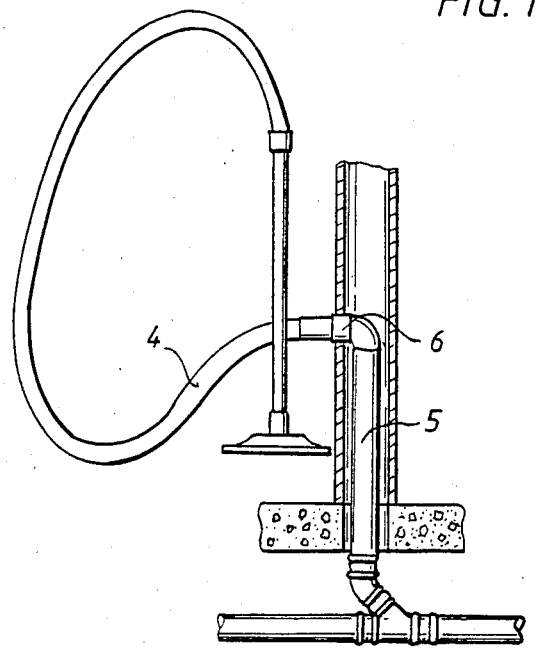
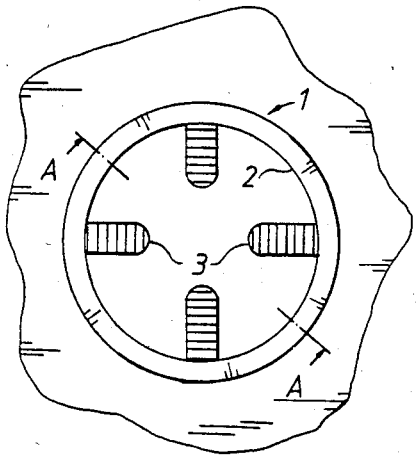
FIG. 2
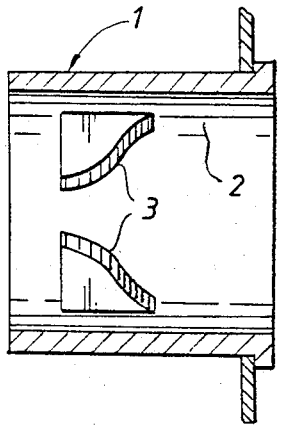
FIG. 3

MOUNTING PIECE FOR SUCTION HOSE OF A CENTRAL VACUUM CLEANING SYSTEM

This invention relates to a mounting piece for a suction hose of a central vacuum cleaning system. The sucking central unit of the central vacuum cleaning system is in apartments placed wholly outside the dwelling space, for example, in a dry store. The main piping, which begins at the central unit and branches off into the different spaces according to requirement, is placed into the floor and wall constructions of the building. A suitable number of suction boxes like electric plug boxes is placed in the apartments and in such places that one can reach everywhere with a suction hose of 5 to 8 meters. When vacuum cleaning one needs only suitable nozzles besides an elastic suction hose and a tubular vacuum wand.

As the piping is installed into the constructions, it is important to prevent it, in different ways, from getting clogged. In addition to the smooth pipe construction without any surfaces that objects collide with, it has been known to use in the connection piece of the suction hose a grating which prevents big objects and pieces of clothing from getting into the piping or unauthorized pushing of articles straight into the suction hose or the pipe. This grating has, however, in practice proved to be easily blocked because, at the same time as it prevents big objects from getting into the piping, it collects hair, bits of thread and pieces of paper that should go through the piping into the refuse container of the central unit when one is vacuum cleaning.

The present invention is intended to provide a mounting piece that does not have the above-mentioned drawbacks and that can be depended on to prevent too big objects from getting into the piping. This has been accomplished in the mounting piece in accordance with the invention thus that on the inner wall of the mounting piece there is at least one rib pointing inwards from the inner wall which prevents objects that would clog the suction piping from getting into the suction piping.

The preferable construction alternatives of the invention are one screw-shaped rib and, for example, four symmetrically placed straight ribs. The mounting piece in accordance with the invention is preferably made an integral part of the suction box, which is set into the wall and connected to the suction piping, or an integral part of the nozzle. The mounting piece can also be adjusted as an adjoint collar to some part of the suction hose.

Figure 4:
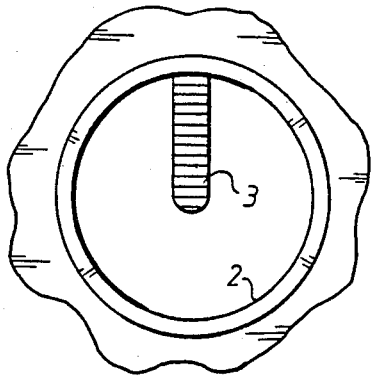
Figure 5:
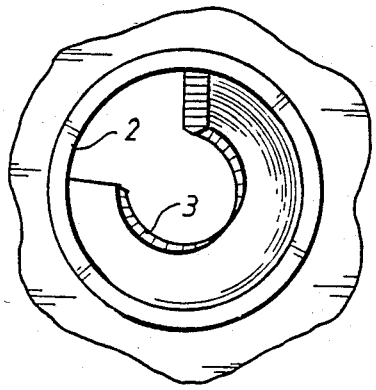
Figure 6:
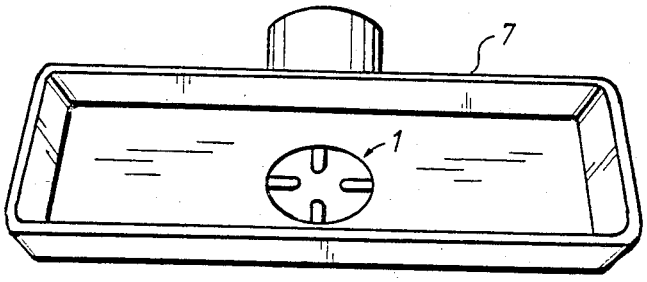

Other preferable constructional details of the invention are depicted in the following, more closely referring to the enclosed drawings, where FIG. 1 is a constructional schematic drawing of a part of the central vacuum cleaning system, FIG. 2 shows a mounting piece in accordance with the invention set into the wall, FIG. 3 shows a section of the mounting piece of FIG. 2 along the line A—A of FIG. 2, FIG. 4 shows a second mounting piece in accordance with the invention set into the wall, FIG. 5 shows a third mounting piece in accordance with the invention set into the wall, and FIG. 6 shows the mounting piece according to FIG. 2 forming an integral part of the nozzle.

FIG. 1 shows schematically a part of the constructional parts of the central vacuum cleaning system. There the suction piping 5 is shown as set into the wall construction and the mounting piece in accordance with the invention and the suction box 6 are set between the suction piping 5 and the suction hose 4.

In FIG. 2 the mounting piece 1 is depicted from the front without the suction hose and the lid of the suction box. In FIG. 2 the mounting piece 1 has four ribs 3 protruding from its inner wall 2. These ribs reach some way towards the centre of the suction opening but, however, leave a sufficient gap in the centre so that only the articles that it is certain are small enough to get through the suction piping will get into it.

As shown in FIG. 3, the surfaces of the ribs 3 that meet the flow are preferably made inclined and smooth with regard to the suction direction, so that bits of thread, hair and corresponding articles that bump into the ribs will go with the air stream along the surface of the rib to the gap in the middle and from there into the pipe.

FIG. 4 shows an embodiment of the mounting piece that differs from the embodiment of FIG. 2. There is only one rib 3, but it is made so long that it reaches the area of the axis of the mounting piece. The surface of this rib that meets the flow has also been made inclined. The rib itself can be placed in a straight or slightly slanting position as regards the flow.

In the embodiment of FIG. 5 there is also only one rib 3, but it winds screwlike along the inner wall of the mounting piece 2. The winding can, for example, be about ½ to 1 turn or even more. Also in this embodiment the surface of the rib that meets the flow is made inclined.

FIG. 6 shows a mounting piece 1 in accordance with the invention resembling the ones shown in FIGS. 2 and 3 forming an integral part of the nozzle 7. The mounting piece 1 is placed in the part of the nozzle that joins the tubular vacuum wand, thus it prevents efficiently too big objects from getting into the suction hose.

A possible place for the mounting piece in accordance with the invention is also the suction hose, into which it is possible to fit it either between the tubular vacuum wand and the suction hose or between the possible extensions of the suction hose.

It is furthermore to be mentioned that the shape of the mounting piece can be some other than the cylindrical form shown in the Figures. For example, a square shape can in principle come into question.

I claim:

1. A mounting piece for a suction hose of a central vacuum cleaning system comprising suction piping (5) placed into floor and wall constructions of a building, said mounting piece (1) being made an integral part of a suction box (6), said suction box being rigidly connected to said suction piping (5) and comprising on the inner wall (2) of said mounting piece (1) at least one rib (3) pointing inwards from the inner walls and preventing objects that would clog said suction piping (5) from pivoting into said suction piping (5) and comprising on the inner wall (2) of said mounting piece (1) at least one rib (3) pointing inwards from the inner wall and preventing objects that would clog said suction piping (5) from getting into said suction piping (5), the surfaces of the rib or ribs that meet the flow being inclined toward the central axis of the mounting piece (1).

2. A mounting piece according to claim 1 wherein the rib (3) reaches the area of the central axis of the mounting piece.

3. A mounting piece according to claim 1, wherein the rib (3) or ribs (3) are parallel to the flow.

4. A mounting piece according to claim 1, wherein the rib (3) is screw-shaped.

5. A mounting piece for a suction hose of a central vacuum cleaning system comprising suction piping placed into floor or wall constructions of a building, said mounting piece being made an integral part of a suction box, said suction box being rigidly connected to said suction piping and comprising on the inner wall of said mounting piece at least one rib protruding inwards from the inner wall not more than one-half the diameter of said suction piping.

6. A mounting piece according to claim 5, wherein the surfaces of the rib (3) or ribs (3) that meet the flow are inclined towards the central axis of the mounting piece.

7. A mounting piece according to claim 5 wherein the rib (3) reaches the area of the central axis of the mounting piece.

8. A mounting piece according to claim 5 the rib (3) or ribs (3) are parallel to the flow.

9. A mounting piece according to claim 5 wherein the rib (3) is crew-shaped.

* * * * *